US010748382B1

(12) United States Patent
Pascal et al.

(10) Patent No.: US 10,748,382 B1
(45) Date of Patent: Aug. 18, 2020

(54) WAGERING GAMES WITH GUARANTEED LOYALTY POINTS

(71) Applicants: Andrew Pascal, Las Vegas, NJ (US); Monty Kerr, Houston, TX (US)

(72) Inventors: Andrew Pascal, Las Vegas, NJ (US); Monty Kerr, Houston, TX (US)

(73) Assignee: Playstudios, Inc., Las Vegas, NV (US)

( * ) Notice: Subject to any disclaimer, the term of this patent is extended or adjusted under 35 U.S.C. 154(b) by 0 days.

(21) Appl. No.: 14/657,381

(22) Filed: Mar. 13, 2015

Related U.S. Application Data

(60) Provisional application No. 61/953,735, filed on Mar. 14, 2014, provisional application No. 62/012,969, filed on Jun. 16, 2014.

(51) Int. Cl.
*A63F 9/24* (2006.01)
*G07F 17/32* (2006.01)
*G07F 17/34* (2006.01)

(52) U.S. Cl.
CPC ..... *G07F 17/3255* (2013.01); *G07F 17/3213* (2013.01); *G07F 17/3225* (2013.01); *G07F 17/34* (2013.01)

(58) Field of Classification Search
CPC .. G07F 17/32; G07F 17/3232; G07F 17/3258; G07F 17/3255
See application file for complete search history.

(56) References Cited

U.S. PATENT DOCUMENTS

| | | | |
|---|---|---|---|
| 5,761,647 | A | 6/1998 | Boushy |
| 6,061,660 | A | 5/2000 | Eggleston et al. |
| 6,267,671 | B1 | 7/2001 | Hogan |
| 6,702,673 | B2 | 3/2004 | Webb |
| 6,883,168 | B1 | 4/2005 | Wood |
| 6,965,868 | B1 | 11/2005 | Bednarek |
| 7,025,674 | B2 | 4/2006 | Adams et al. |
| 7,086,947 | B2 | 8/2006 | Walker et al. |
| 7,419,428 | B2 | 9/2008 | Rowe |
| 7,562,873 | B1 | 7/2009 | Luciano, Jr. |
| 8,177,630 | B2 | 5/2012 | Bryant et al. |

(Continued)

OTHER PUBLICATIONS (author unknown), "How to Earn Myvegas Loyalty Points & Rewards Fast on Facebook", https://999thepoint.com/how-to-earn-myvegas-loyalty-points-rewards-fast-on-facebook/, Dec. 5 2013.

(Continued)

*Primary Examiner* — James S. McClellan
*Assistant Examiner* — Kevin M Carter
(74) *Attorney, Agent, or Firm* — Muskin and Farmer LLC

(57) ABSTRACT

A method, apparatus, and computer readable storage to implement a guaranteed loyalty point system. A player is provided a fixed amount of guaranteed loyalty points which are converted to loyalty points as the play plays wagering games such as slot games. When the amount of guaranteed loyalty points is depleted, then the player continues to player the slot game but no further loyalty points are awarded to the player until the player once again possesses some more guaranteed loyalty points. In this way, the amount of loyalty points a player ultimately receives is not dependent on luck. The loyalty points can be redeemed for tangible goods and/or services (e.g., show tickets, meal at a restaurant, etc.).

16 Claims, 9 Drawing Sheets

(56) References Cited

U.S. PATENT DOCUMENTS 8,342,399 B1 * 1/2013 McGhie ..... G06Q 20/02 235/375
8,568,212 B2 10/2013 Gagner et al.
8,597,109 B2 12/2013 Herrmann et al.
8,807,427 B1 * 8/2014 McGhie ..... G06Q 30/0228 235/375
8,986,122 B2 3/2015 Kelly et al.
8,992,326 B2 3/2015 Kelly et al.
9,711,004 B1 * 7/2017 Ellis ..... G07F 17/3244
9,911,133 B1 3/2018 Walbran et al.
2002/0002075 A1 1/2002 Rowe
2002/0151359 A1 10/2002 Rowe
2002/0169021 A1 11/2002 Urie et al.
2003/0032474 A1 2/2003 Kaminkow
2003/0083126 A1 5/2003 Paulsen
2003/0083943 A1 * 5/2003 Adams ..... G06Q 30/02 705/14.23
2003/0171145 A1 9/2003 Rowe
2003/0171149 A1 9/2003 Rothschild
2003/0211878 A1 11/2003 Walker et al.
2004/0097287 A1 5/2004 Postrel
2004/0142750 A1 7/2004 Glisson et al.
2004/0254005 A1 12/2004 Shackleford et al.
2005/0143166 A1 6/2005 Walker et al.
2005/0170883 A1 * 8/2005 Muskin ..... G06Q 20/342 463/25
2005/0261056 A1 * 11/2005 Smolucha ..... G07F 17/3239 463/25
2005/0266919 A1 * 12/2005 Rowe ..... G06Q 20/02 463/25
2006/0259361 A1 11/2006 Barhydt et al.
2007/0032286 A1 2/2007 Muir
2007/0060303 A1 * 3/2007 Govender ..... G06Q 20/06 463/25
2007/0117613 A1 * 5/2007 Hoover ..... G07F 17/32 463/25
2007/0167210 A1 * 7/2007 Kelly ..... G07F 17/32 463/16
2007/0215690 A1 9/2007 Shea et al.
2008/0026822 A1 1/2008 Walker et al.
2008/0176619 A1 7/2008 Kelly et al.
2008/0220857 A1 9/2008 Kelly
2009/0054149 A1 * 2/2009 Brosnan ..... G07F 17/32 463/42
2009/0117989 A1 5/2009 Arezina et al.
2009/0124362 A1 * 5/2009 Cuddy ..... G07F 17/32 463/27
2009/0209332 A1 * 8/2009 Soukup ..... G07F 17/32 463/27
2010/0227675 A1 * 9/2010 Luxton ..... G07F 17/32 463/25
2010/0240443 A1 * 9/2010 Baerlocher ..... G07F 17/32 463/25
2010/0311496 A1 12/2010 Taylor et al.
2011/0092272 A1 4/2011 Wilcox
2012/0150695 A1 * 6/2012 Fan ..... G06Q 30/0641 705/27.1
2013/0084961 A1 * 4/2013 Radisich ..... G07F 17/3255 463/25
2013/0102380 A1 * 4/2013 Olomskiy ..... G07F 17/3223 463/25
2014/0012652 A1 * 1/2014 Levin ..... G06Q 30/0233 705/14.31
2015/0065219 A1 * 3/2015 Kiely ..... G07F 17/3211 463/13
2015/0178761 A1 6/2015 O'Connor et al.
2015/0310701 A1 10/2015 Conklin et al.

OTHER PUBLICATIONS

Memorandum Opinion, United States District Court for the Northern District of Illinois, *Phillips* vs. *Double Down Interactive LLC*, Mar. 25, 2016, Case: 1:15-cv-04301, Document #59.
Internet Archive, appeared Apr. 4, 2004, (3 pages) http://web.archive.org/web/20040404125755/www.avicasino.com/xsp/register.xsp.
Slotomania (on Facebook), (visited Jan. 6, 2014), screen shot showing slot game and screen shot showing "level up" (2 Pages).

* cited by examiner

Loyalty points: 23

WAGERING GAMES WITH GUARANTEED LOYALTY POINTS

CROSS REFERENCES TO RELATED APPLICATIONS

This application is related to U.S. application Ser. No. 14/144,581, which is incorporated by reference herein in its entirety. This application is also related to U.S. nonprovisional application Ser. No. 13/472,454, which is incorporated by reference herein in its entirety. This application is also a continuation in part of both U.S. application Ser. No. 14/144,581 and U.S. application Ser. No. 13,472,454. This application claims benefit to 62/012,969 which is incorporated by reference herein in its entirety. This application also claims benefit to 61/953,735 which is incorporated by reference herein in its entirety.

BACKGROUND OF THE INVENTION

Field of the Invention

The present general inventive concept is directed to a method, apparatus, and computer readable storage medium directed to a game that allows players to earn loyalty points while playing casual games.

SUMMARY OF THE INVENTION

It is an aspect of the present invention to provide an improved mechanism for players to earn loyalty points.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
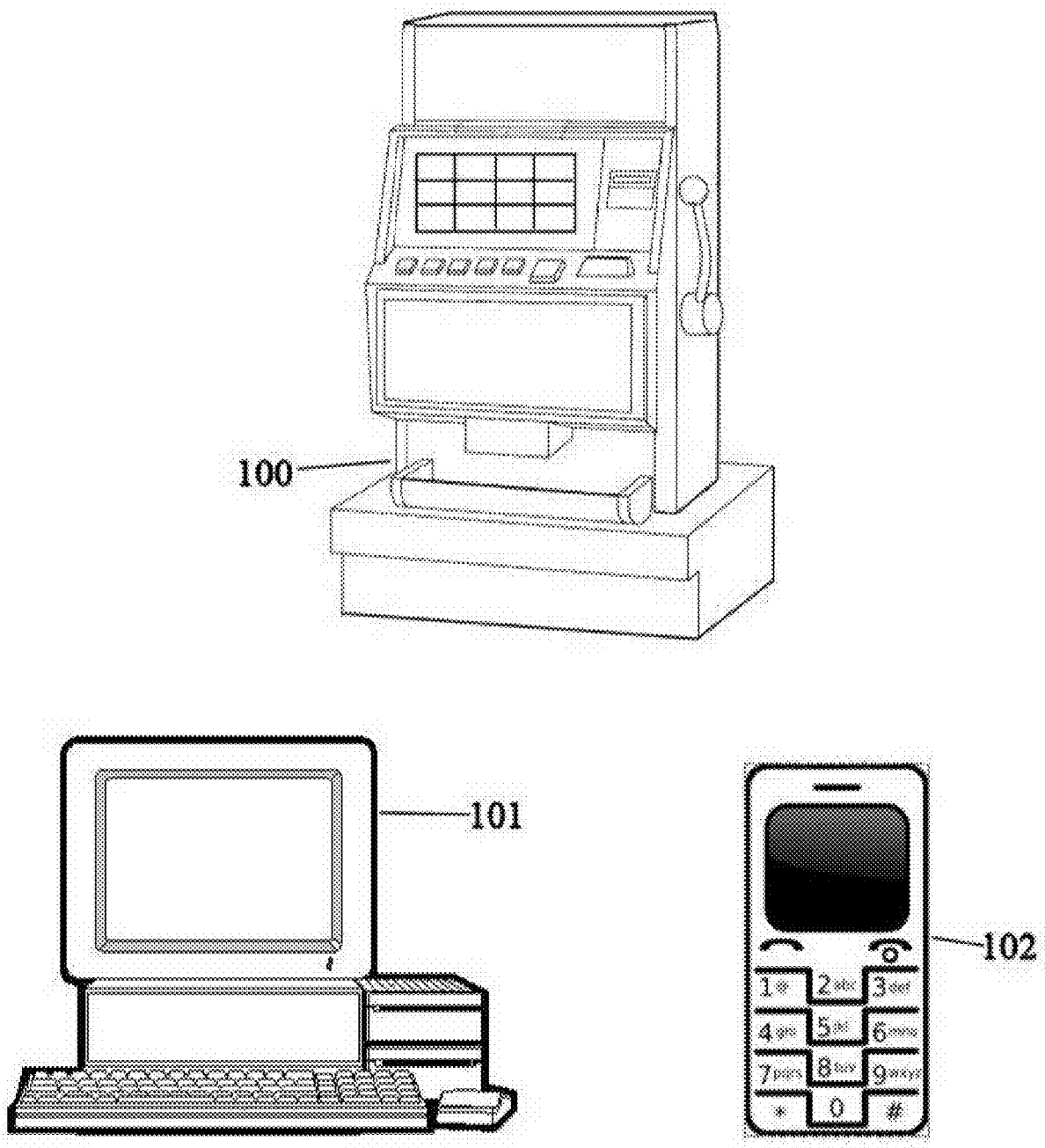
FIG. 1 is a drawing illustrating numerous apparatuses that can play the game described herein, according to an embodiment.

Reference will now be made in detail to the presently preferred embodiments of the invention, examples of which are illustrated in the accompanying drawings, wherein like reference numerals refer to like elements throughout.

The present inventive concept relates to combining experiences on physical electronic gaming devices found in casinos (e.g., slot machines) with games that can be played online. Online games can include games played on a social networking site such as FACEBOOK (including what is described in U.S. Pat. No. 7,669,123 which is incorporated by reference herein in its entirety), MYSPACE, or any other site which maintains a database of users and provides an interface for interaction.

Players can earn a loyalty points (also referred to herein as secondary currency or virtual points) by playing online (using a computer using the internet to play an online game such as one on FACEBOOK). Loyalty points typically have no cash value. The online game can be an online casino or any other game. The secondary currency/loyalty points can be earned as described herein. Loyalty points can be redeemed for tangible goods. For example, a list of tangible items (e.g., free room at a particular hotel, show tickets for a particular show, deck of playing cards, etc.) can all be displayed alongside a cost in loyalty points, and the player can choose which item the player wishes to receive upon which the respective number of loyalty points will be deducted from the player's account (assuming the player has the required number of loyalty points) and the player will be delivered the item (electronically such as via an email/text or physically).

FIG. 1 is a drawing illustrating numerous apparatuses that can play the slot machine game described herein, according to an embodiment. Other types of games can be implemented as well (e.g., blackjack, etc.)

The game described herein can be played on an electronic gaming machine 100 that can found in brick and mortar casinos or other venues such as internet cafes, etc. Cash (or cashless vouchers) can be inserted into the machine 100 using a bill acceptor which credits the machine with a respective amount of credits which can then be used to play the game, and winnings are paid out in the form of credits which can then be cashed out for cash or a cashless voucher that can be redeemed for cash. The game described herein can exist on a software module pre-installed on the slot machine 100 or can be downloaded to the electronic gaming machine 100 from a central remote server.

The game described herein can also be played on a computer 101 such as a personal computer, laptop, etc. The game can be downloaded to the computer 101 and stored locally on the computer 101. Alternatively, the computer 101 can have an internet connection (not illustrated) so that the game can be served from a remote location and player and displayed on the computer 101. For example, the game can be played on an online casino (wherein the player can wager for real money using a credit card or other deposit method, where legal) in which the results are determined on a remote server and transmitted to the computer 101 so that the computer displays the results. The game can also be played on the computer 101 for "casual play" on a social networking site (e.g., FACEBOOK, MYSPACE, etc.) wherein the game software can be launched from within the social network site itself "Casual play" is where the game can be played not for real money but for credits which typically have no cash value, but can have other benefits to the player.

The game described herein can also be played on a cell phone 102 or any other type of portable device, such as a tablet computer, etc. The portable device can implement any of the paradigms described herein with respect to the computer 101 (e.g., online casino, social networking site, etc.)

Figure 2:
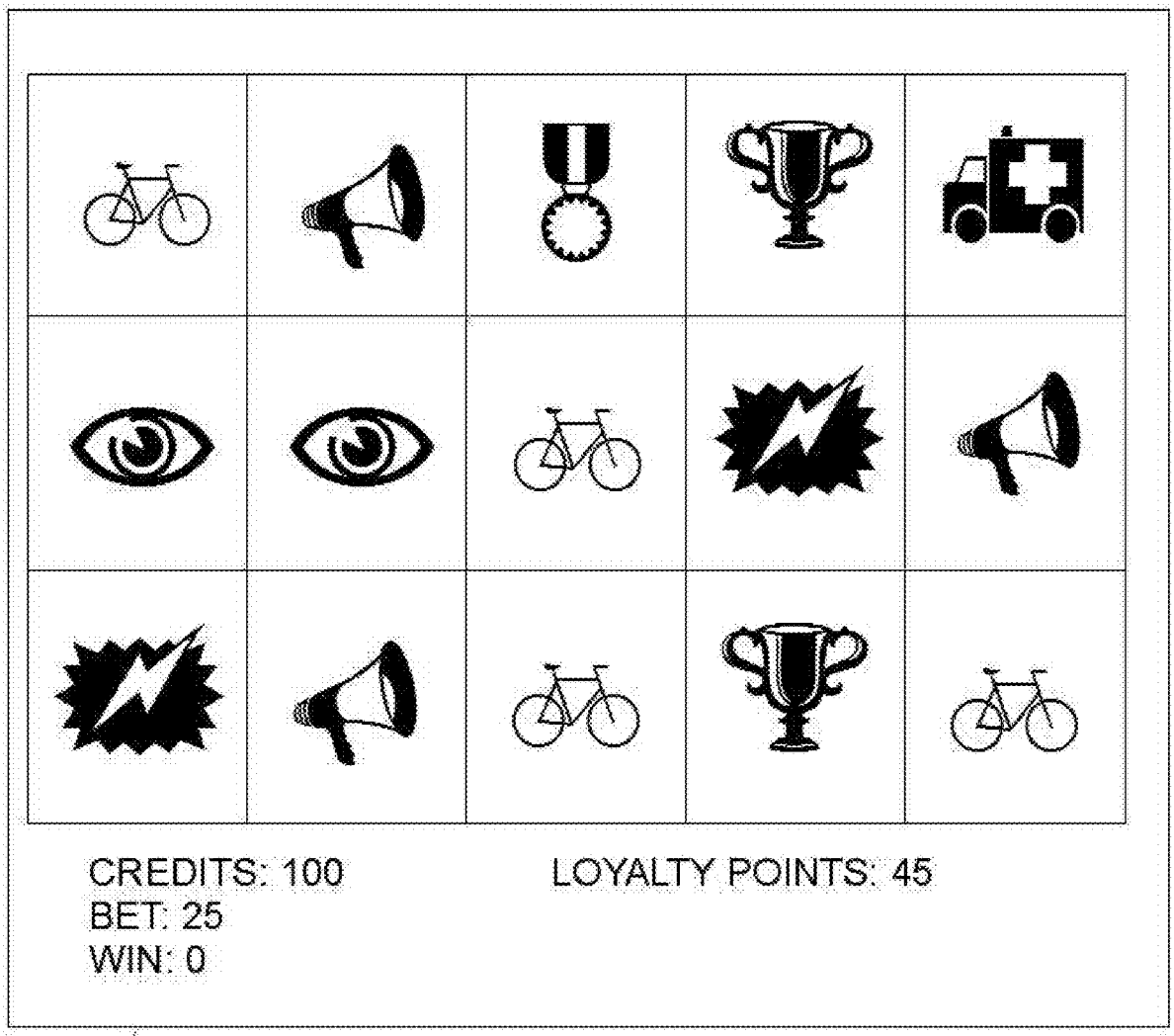
FIG. 2 is a drawing of a slot machine game that can be played online or on a physical electronic gaming machine, according to an embodiment.

FIG. 2 is a drawing of a slot machine game that can be played online or on a physical electronic gaming machine, according to an embodiment.

The slot machine game can be any type of slot machine game, such as three reel, five reel, etc. For an example of a slot machine game, see U.S. Pat. No. 8,251,798 which is incorporated by reference herein in its entirety.

A player can earn loyalty points in numerous ways. See U.S. application Ser. No. 13/472,454, 61/747,822, and Ser. No. 13/767,257 (all three applications of which are incorporated by reference herein in their entireties) which describe ways a player can earn loyalty points. Loyalty points are typically earned from playing games online that are part of the entire system. For example, a player can earn loyalty points based on the amount of non-cash value credits wagered (e.g., for each 10 non-cash value credits, the player earns 1 loyalty point). Players typically would not have to pay cash in order to earn loyalty points.

"Cash credits" refers to credits the player may have on an electronic gaming device which can be cashed out instantly for a cashless voucher which is redeemable for cash at a ticket redemption machine or casino cashier cage. For example, a player deposits a $100 bill into a bill validator in an electronic gaming machine, he has $100 cash credits. Assuming the player plays the electronic gaming machine and wins $50, the player's credit meter reflects that he has $150 cash credits in which the player can immediately cash out at any time and redeem for cash.

Non cash value (NCV) credits (also referred to as non cash value chips) are credits which cannot be directly converted into cash. Non cash value credits can be used to play a slot machine game (or any other electronic wagering game). Non cash value credits can be purchased using cash or earned by completing tasks. Some non cash value credits may be given away for free to players who meet certain conditions.

The present general inventive concept relates to removing any type of luck from the determination of how many loyalty points a player earns. Thus, if different players play the games (who would like achieve different results on the wagering games due to the random number generators), they would both ultimately receive the same amount of loyalty points. This can be accomplished by awarding each player a same amount of guaranteed loyalty points for performing the same actions (e.g., signing in, playing, purchasing non-cash value credits, etc.) As the player plays, guaranteed loyalty points are converted to loyalty points so that ultimately all of the players who take the same actions will end up with the same amount of loyalty points. The player will not be told/shown how many guaranteed loyalty points (GLP) they have, although in another embodiment they can be. The amount of loyalty points a player has would typically always be shown (or available to be shown) to the player.

In FIG. 2, the electronic output display shows "credits: 100" which is the amount of non-cash value credits the player has, "bet: 25" which shows the player's bet is 25 non-cash value credits, "win:0" means this was a losing spin (no award), and "loyalty points: 45" shows that the player currently has 45 loyalty points. Loyalty points can be redeemed for tangible goods and services.

Figure 3:
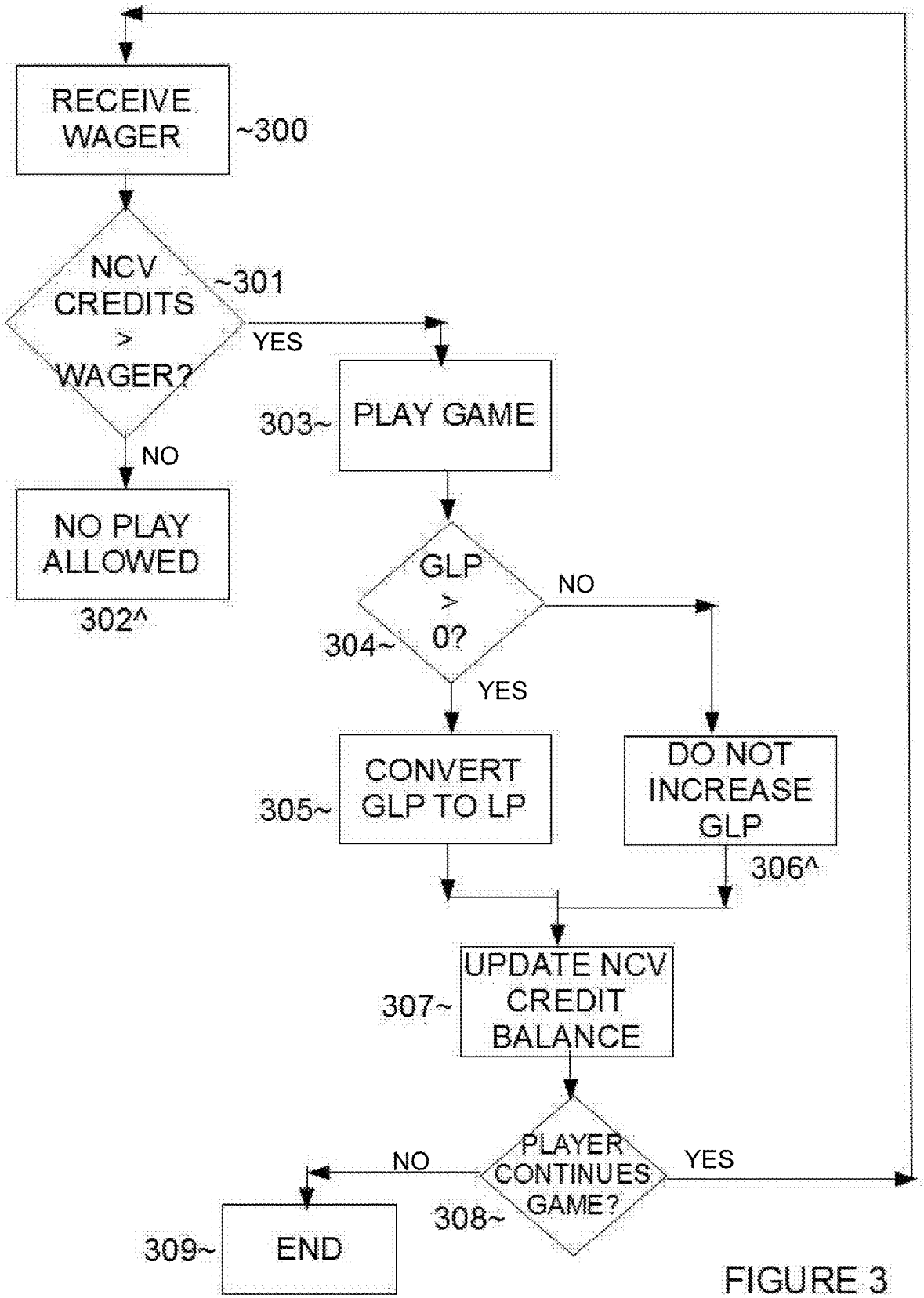
FIG. 3 is a flowchart illustrating an exemplary method of implementing a wagering game with guaranteed loyalty points, according to an embodiment.

FIG. 3 is a flowchart illustrating an exemplary method of implementing a wagering game with guaranteed loyalty points, according to an embodiment.

In operation 300, a wager in non-cash value credits (also referred to as non-cash value chips) is received. NCV (non cash value) credits can be given for free or purchased by the player but are not redeemable for cash or goods. The words "wager" and "wagering game" are used herein which apply to wagers for non-cash value credits (even though these are not cash). Thus, in operation 300, the player can indicate a wager amount (or one can be indicated automatically for the player) and the player presses a "spin" button (or other activation button) on the screen.

From operation 300, the method proceeds to operation 301, which determines whether the player has enough NCV credits to play the game. If the player attempts to wager more NCV credits than the player current has (a credit meter is typically displayed which displays to the player how many NCV credits the player has) then the method proceeds to operation 302 which would not allow the player.

In operation 302, the player can be presented with a message that the player has insufficient funds and can be presented with a screen prompting the player to purchase more NCV credits. Note that a player who runs out of NCV may not be able to continue to convert their GLP to LP and thus this situation may be prevented in numerous ways. In an embodiment, players who run out of NCV credits can be given more NCV credits for free. In another embodiment, players who run out of NCV credits can automatically have all of the GLP converted into LP. In a further embodiment, a player can be told to come back later (after a predetermined amount of time) and receive more free NCV or the player can be presented with a button that when pressed would immediately convert their GLP to LP.

In operation 301, if the player has more NCV credits, then the method proceeds to operation 303, wherein the computer plays the game (e.g., spins the reels to a random result).

The method proceeds to operation 304 which determines whether the player has guaranteed loyalty points left. The player currently has a running total of guaranteed loyalty points (GLP) which is maintained in the player's account (along with the running total of loyalty points (LP) which is also maintained in the player's account).

If in operation 304, it is determined that the player does not have any guaranteed loyalty points left, then the method proceeds to operation 306 which would not give the player any more GLP. If an accumulated wager total meter is being this would be turned off as well (not shown, shown as faded out and not used, or shown but not used). An accumulated wager total meter can be used to graphically show the player his/her progress in earning loyalty points. For example, a player may have to wager 50 NCV (or other amount) credits to earn 1 loyalty points, and a meter representing the 50 NCV can continuously increase based on the amount of wagers placed until the meter reaches the 50 NCV credits (i.e. the player has wagered 50 NCV credits) upon which the loyalty meter is reset to 0 and the player is awarded the 1 loyalty point. The accumulated wager total meter is described in U.S. application Ser. No. 14/144,581 which is incorporated by reference herein in its entirety. In operation 306, even if no further loyalty points are being awarded (since there are no more GLP) the loyalty point meter (which displays the amount of loyalty points the player currently has) would still be displayed (even though it would not increase). From operation 306, the method proceeds to operation 307.

If in operation 304, the player has GLP in his/her account, then the method proceeds to operation 305, which converts GLP to LP. Typically the conversion from GLP to LP is a 1:1 ratio (1 GLP converts to 1 LP), thus 1 point is deducted from the player's GLP total and 1 point is added to the player's LP total. The conversion can be in ratios as well (e.g., 2 GLP converts to 1 L).

The amount of LP provided to the player in operation 305 can be computed in a number of ways. In one embodiment, for each spin a fixed amount (e.g., 1 points) would be added to the player's LP (and a corresponding point would be deducted from the player's GLP).

In another embodiment, the amount of LP provided to the player is based on the wager amount. For example, the wager amount multiplied by a constant is the amount of LP earned by the player (converted from GLP). For example, if the constant is 0.5 and the wager amount is 50 NCV, then the amount of LP points awarded to the player is 0.5*50=25, thus the player earns 25 more LP (and 25 is deducted from the player's GLP which is typically not shown to the player). In this manner, a player has a fixed amount of GLP which will ultimately be converted to LP even though the conversation may occur at different rates based on the amount of play by the player and bet amounts. A player who bets more would earn the LP more quickly as compared to a player who bets relatively less per spin, but the lower betting player will still eventually catch up to the bigger betting player over time. As illustrated in FIG. 3, once a player collects all of their GLP as LP, they will not earn any more LP until the player is awarded more GLP (which can happen based on a number of actions or at random). Thus, two players may play for different lengths of time and with different bet amounts, but ultimately the two players will still earn the some number of loyalty points. Thus the element of luck is removed from the determination of LP since the results of the game have no bearing (directly or indirectly) on the amount of GLP (and hence the LP) the player will earn. Thus a player who is very lucky on the games (e.g., wins a large jackpot on the slot machine) as compared to an unlucky player (who loses on most spins and does not win a jackpot) would still ultimately earn the same amount of LP in the end. Since LP can be redeemed for tangible prizes, the method illustrated in FIG. 3 levels the playing field as per different players so that the luckier player would not be able to earn more (or higher valued prizes) with their LP since the amount of LP they both earn will ultimately be the same.

Note that in operation 305, if the player does not have enough GLP to be converted into LP (according to the formula), then all of the player's remaining GLP will be converted to LP (and since the amount of GLP will then be zero so the next spin the method will reach operation 306 instead of operation 305).

From operations 305, 306, the method proceeds to operation 307, which updates the NCV credit balance based on the result of the game played in operation 303. The result of the game (e.g., a slot machine spin) will be compared to a paytable of predetermined results and winning spins will be awarded a respective amount of NCV and losing spins will not be awarded any NCV.

From operation 307, the method proceeds to operation 308, which determines whether the player continues playing the game. The player is free to stop playing at any time (by pressing a button on the screen) which would proceed to operation 309 which would return to another part of the system (e.g., a menu of other games or can terminate the games in their entirety) or continue playing.

If in operation 308, the player wishes to continue playing then the method returns to operation 300 which can receive another wager from the player to initiate another spin of the game (or other type of game such as a new hand of blackjack).

Note that even though the method may reach operation 306 when the player no longer has any GLP, the player may eventually earn more GLP (as described herein). Once the player has GLP again, then the method would proceed to operation 305 instead of 306.

Note that the player can also be given an opportunity to immediately convert all of their GLP to LP. If the player does not wish to wait until the player has played enough to make the conversion, the player can initiate a full conversion of all of his/her GLP to LP. This full conversion can be initiated by the player pressing a button designated from this purpose (e.g., "retrieve all potential loyalty points"). The full conversion can also be initiated by the player visiting a particular screen. For example, if the player goes to the redemption screen (where the player is able to redeem their loyalty points for tangible goods/services), all of the player's remaining GLP can automatically be converted to LP (so the player will no longer have any GLP) so that the player has the maximum amount of LP when reviewing the potential goods/services the player can redeem with his/her LP. If the player has been inactive (has not played any of the games on the platform) for a predetermined amount of time (e.g., 72 hours) then this can also trigger an automatic conversion of all of the player's GLP to LP.

GLP can be awarded to players upon certain events taking place. For example, if a new player registers for a new account, then the player can be awarded a fixed amount of GLP (e.g., 1,000 GLP). If the player comes back to the game after a waiting period (e.g., 24 hours), the player can earn a fixed amount of GLP (e.g., 100 GLP).

Note that in some cases the conversion from GLP to LP happens gradually (e.g., over spins/plays of a slot machine). In other cases, a conversion from GLP to LP can happen in a "burst", that is a large amount of LP can be awarded (which is converted from LP). For example, a bonus game can be presented to the player (such as a wheel spin, etc.) which can award the player a relatively large number of LP (more than a spin on the slot game) which is converted from the GLP. LP awards converted from the GLP can be random. However, in some cases awards can be made to the player's LP without taking it from the GLP. These types of awards should not be random but should be predetermined (fixed) across all of the players, so that one player cannot win more LP over another player because of luck.

Figure 4:
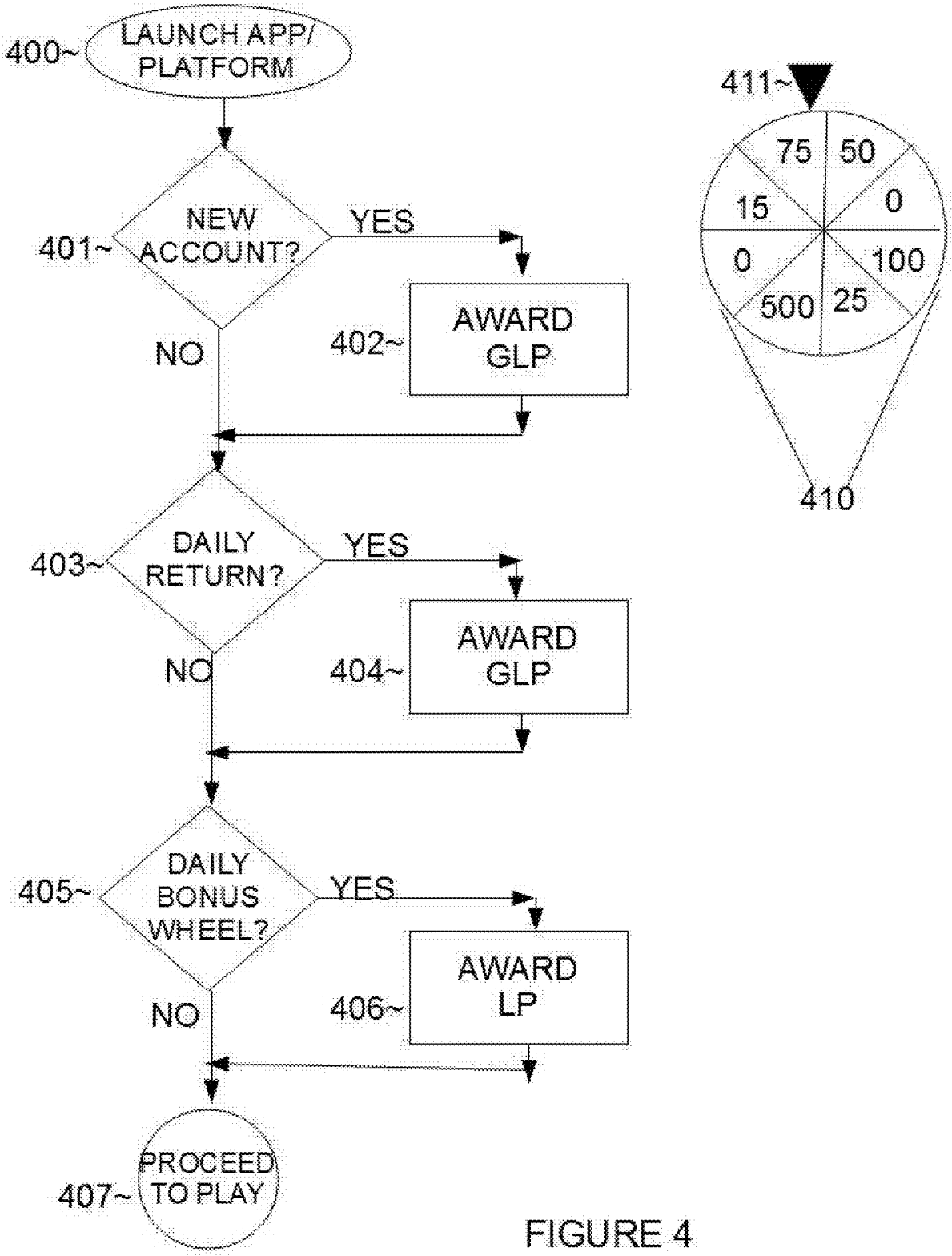
FIG. 4 is a flowchart illustrating a method of awarding GLP to a player based on activities, according to an embodiment.

FIG. 4 is a flowchart illustrating a method of awarding GLP to a player based on activities, according to an embodiment. Note that each time the player is awarded GLP (from any source), the player's running total of GLP is increased by that amount. The player's account (which can be hosted by the host server 510 or the game server 514 or other database/server) maintains all of the stats (e.g., amount of NCV credits, GLP, LP, and any other value used by the system) of a player's account regardless of when the player plays and is always accessible by the system when the player plays.

In operation 400, a player launches an app (e.g., on the ANDROID or IOS platform) or launches the game through a social networking site such as FACEBOOK.

From operation 400, the method proceeds to operation 401, wherein it determines if the player is opening a new account. A new player who has not played on the game platform before (not played any of the games offered by the platform) needs to register an account first before the player can play. When opening an account, the system would award a predetermined amount of GLP. All players would be awarded the same amount of GLP when they open an account.

In operation 403, it is determined if the player has made a daily return. A daily return is where a player returns to the game app/platform the next day (e.g., at least 24 hours (or other amount of time) after the last time the player played on the app/platform). Upon each daily return, all players would be awarded the same fixed amount of GLP. If a player returns less than 24 hours after the last play then this would not be considered a daily return and the player would not be entitled to this particular bonus award. A first player who makes more daily returns than a second player would earn more GLP than the second player. However, luck has nothing to do with a player who earns more GLP in this manner.

In operation 405, it is determined whether the player is entitled to a daily bonus wheel spin. For example, each daily return the player makes (or the first time of each calendar day the player initiates the app/platform) a daily bonus wheel spin can be implemented. The daily bonus wheel spins a wheel which has slices which displays different amounts of loyalty points the player would earn. The wheel 410 spins, stopping on a particular slice that falls under a marker 411, and the respective amount of loyalty points on that slice is awarded to the player. Note that the loyalty points awarded to the player can be predetermined or random, but the loyalty points actually awarded are converted from GLP. So regardless of the "luck" of the spin, the player is not really receiving a random amount of loyalty points but is just receiving a conversion from his/her GLP (even though the player may not realize the LP are being derived from his/her GLP). Thus, the player is not really "winning" anything, as the player is only receiving LP that is being converted from the player's GLP. In an embodiment, the wheel can stop on a slice that contains the entire amount of GLP that the player possesses. Thus, each time the wheel spin is implemented, all of the player's GLP is converted to LP. Note that unlike operations 402 and 404 (which awards GLP), operation 406 directly awards LP to the player (the player can be presented with a message saying "you have earned 20 loyalty points!"). Note that as an alternative to a wheel, other games can award LP as well in the same manner, such as a slot machine game, dice game, etc.

In another embodiment, operation 406 can award LP without converting it from GLP. For example, each player would always earn a predetermined 50 LP upon initiating the app and spinning (as described above) the wheel (even though the wheel would spin with different values on it, it would always stop on 50) which directly increases the player's LP without affecting the GLP. Note that all players would receive this bonus LP so that there is no luck involved, as one player would not earn more LP than another player.

In operation 407, the method can proceed to operation 300 wherein the player can begin playing a game. The player can also be presented with a choice of games (e.g., different slot machines, table games such as blackjack, etc.) and the player can choose which game to start playing.

Note that the player can purchase additional NCV credits (also referred to as NCV chips) using real cash at any point in time. In one embodiment, purchasing NCV credits has no effect on the amount of GLP the player has. In another embodiment, the purchase of NCV credits would also award the player GLP as well. The player can earn GLP in proportion to the amount of NCV credits the player has purchased. For example, the amount of GLP awarded to the player is computed as the amount of NCV chips the player is purchased multiplied by a constant. For example, if the constant is 1.5, then if the player purchases 1000 NCV credits, then the player is awarded 1,500 GLP which is added to the players GLP total in his/her account. Thus different players who purchase NCV will always be awarded the same amount of GLP. In another embodiment, the amount of GLP awarded from a purchase of NCV is computed as the amount of cash spent to purchase the NCV credits multiplied by a constant. For example, if the player spends $20 to purchase NCV credits (regardless of how many NCV credits the player receives) and the constant is 3, then the amount of GLP awarded to the player for the purchases will be computed as 20*3=60 GLP added to the player's total of GLP.

Thus, using the methods described herein, different players can play in different amounts (some more frequently than others), and make different size wager amounts, but the ultimate amount of LP they earn will still be the same. If a first player purchases more NCV credits than a second player, then in an embodiment the first player would receive more NCV credits than the second player. If a first and second player make the same purchase of NCV credits, then both players will be awarded the same amount of GLP. A first player who returns to the game and collects more daily returns than a second player would collect more GLP than the second player.

Note that if two different players take the same actions, then those two players will earn the same amount of GLP (and hence the same amount of LP). Players may have different betting habits and thus players may have their GLP converted to LP at different rates, but ultimately the amount of LP players who have taken the same actions have will be the same. Thus, for two players who have taken the same actions (e.g., made the same purchases, played at the same times, etc.) luck has no influence on how much LP the player would ultimately get as both players would ultimately have identical amounts of LP when their GLP is all converted. However, a more active player (e.g., one who collects more daily returns) may earn more GLP than an inactive player but this has nothing to do with luck, only that the more active player has intentionally made more activity than the less active player.

The Table I below illustrates an example of how different players who take different actions would ultimately still have the same GLP and ultimately the same LP. Player A and player B both receive a starting bankroll of 100,000 NCV credits. Player A and player B both receive 650 GLP for signing up. Player A and player B also both receive 50 LP directly as a daily bonus (e.g., a daily bonus wheel or other bonus). Player A has an average bet of 5,000 while player B has an average bet of 500. The amount of GLP converted to LP is 0.0003 for each NCV credit wagered. Note that player A has earned 333 LP (total wagers multiplied by 0.0003) and player B has earned 33 LP (total wagers multiplied by 0.0003). Thus, Player A and player B both each started with 700 GLP. Player A earned 333 LP from playing which leaves player A with 317 in GLP. Player B earned 33 LP from playing which leaves player B with 617 GLP. Note that both player A and player B have the same ultimately LP of 700 (650 to start with plus the 50 awarded in the bonus). Note that player A currently has 333 LP from playing plus 50 LP from the bonus equals 383 LP, while player B currently has 33 LP from playing plus 50 LP from the bonus equals 83 LP. Since player A currently has 383 LP and has 317 GLP, player A has a total of 700 combined points (LP+GLP). Player B currently has 83 LP and has 617 in GLP, player B has a total of 700 combined points. In this example, the conversion ratio is 1:1 (a GLP is converted to 1 LP). While player a currently has more LP than player B, upon continued play both player A and player B will have the same amount of LP because player A (continuing to play at the increased bet amount) will stop earning LP before player B (who is betting less than player A) stops earning LP. Eventually, both players after continued play would both have 700 LP and 0 GLP. In an embodiment, each player would also have the opportunity to immediately convert their GLP to LP, thus player A and player B could each press a button and suddenly have their 700 LP and 0 GLP. Typically, each player would see how many LP they have but would not see how many GLP they have.

Thus, the amount of ultimate LP earned is not tied to any element of chance. The length of play also should have no bearing on the ultimate LP, although in some embodiments player who appear on the game more often can collect the daily return and other bonuses. There should also be no ultimate LP award for advancing in the game or reaching a new level. And there should be no ultimate LP award for the completion of challenges (completing one or more tasks in a game such as finding hidden objects). Ultimate LP is the amount of LP earned by a player after all of the player's GLP is converted. Random or task based LP awards can be made as long as they are converted from the player's GLP.

TABLE I

| Example | Player A | Player B | Notes |
|---|---|---|---|
| Instant delivery | | | |
| Daily Bonus 1 | 50 | 50 | Delivered at time of spinning daily bonus wheel |
| Incremental delivery | | | |
| Starting bankroll | 100,000 | 100,000 | same starting bankroll |
| Hold % | 9% | 9% | same game/hold % |
| Bet amount | 5,000 | 500 | different average bets |
| LP delivered/chip wagered | 0.0003 | 0.0003 | same delivery factor per chip wagered |
| # of wagers | 222 | 222 | same number of propositions |
| Total coin-in | 1,111,111 | 111,111 | difference in coin-in due to different bet amounts |
| Total amount claimed | 333 | 33 | LP delivered/claimed by actively playing game |
| Guaranteed LP Credit | | | |
| Starting Guaranteed LP Balance | 650 | 650 | Amount Guaranteed for both based on accrual criteria |
| Amount Claimed | 333 | 33 | Amount claimed during game play\- |
| Guaranteed LP Credit | 317 | 617 | amount to be automatically credited to insure both players receive the same amount |
| Total LP Delivered | 700 | 700 | Same LP delivered to both players irrespective of chance or bet amount |

Note that the player is able to convert the loyalty points (but not the guaranteed loyalty points) into tangible goods/items and services. The player can be presented with a display which shows items and respective prices in loyalty points. Table II shows a sample output of items and respective loyalty point costs. Of course the player must have the required amount of loyalty points in order to redeem the item. Once the player initiates a redemption (using a graphical user interface and a touch screen and/or mouse), the amount of loyalty points for the item is deducted from the player's account. Players cannot use non-cash value credits to redeem for items, nor can non-cash value credits be redeemed for cash.

TABLE II

| Item | loyalty point cost |
|---|---|
| Show to "Green Man Group" | 1000 loyalty points |
| 2 buffet tickets to ABC buffet | 50 loyalty points |
| One pair of fuzzy dice | 10 loyalty points |
| 1 night stay in mega-suite at XY hotel | 5000 loyalty points |

Figure 5A:
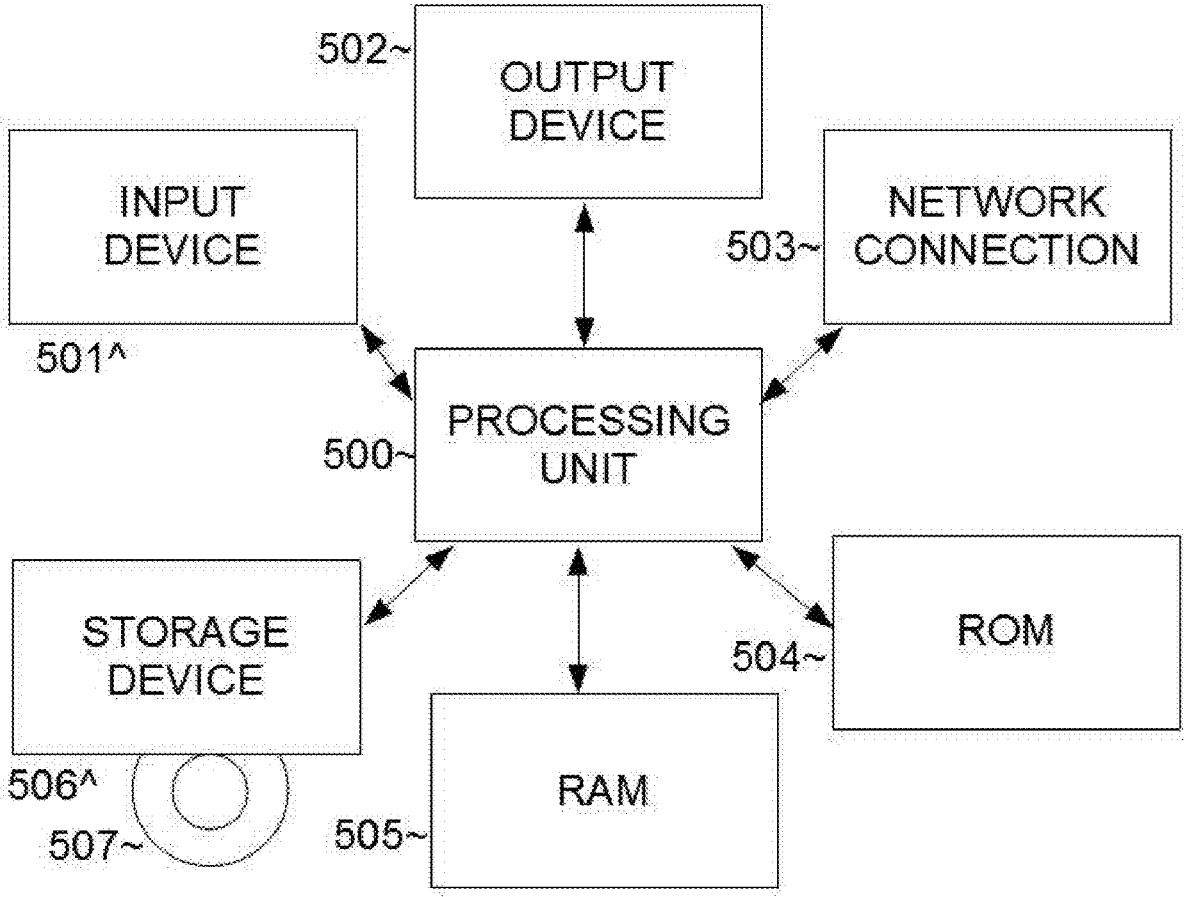
FIG. 5A is a block diagram illustrating exemplary hardware that can be used to implement the game described herein, according to an embodiment.

FIG. 5A is a block diagram illustrating exemplary hardware that can be used to implement the game described herein, according to an embodiment. The hardware in FIG. 5A can be used to implement a computer implementing the game described herein and/or a server that is serving the game to a computer which is displaying the game to a player. Such a server can interface with a social networking site (e.g., FACEBOOK, MYSPACE, etc.) that is used to coordinate the entire game and communicate with the players as well as a server used by the social network site.

A processing unit 500 can be a microprocessor and associated structure (e.g., bus, cache, clock, etc.) which can be connected to an input device (e.g., touch-screen, keyboard, mouse, buttons, etc.), and an output device (e.g., touch-screen, CRT, monitor, etc.) The processing unit 500 can implement any of the methods described herein. The processing unit 500 can also be connected to a network connection 503 which can connect to a computer communications network such as the Internet, Wi-Fi, LAN, WAN, etc. The processing unit 500 can also be connected to a ROM 504 and a RAM 505 as used in the art. The processing unit 500 can also be connected to a storage device 506 which can be nonvolatile storage device (e.g., BLU-RAY drive, CD-ROM drive, hard drive, EPROM, etc.) A computer readable medium 507 (e.g., BLU-RAY disc, CD-ROM, hard disc, etc.) can be read by the storage device 506 and can store programs and assets that can cause the processing unit 500 to perform any of the methods described herein. The ROM and RAM can also be loaded with instructions that can cause the processing unit 500 to perform any of the methods described herein.

Figure 5B:
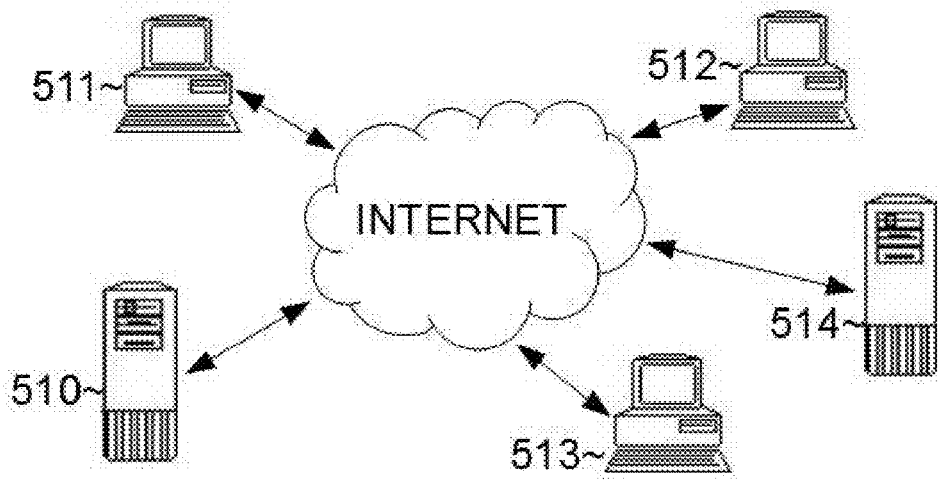
FIG. 5B is a network diagram showing a network structure for a social networking web site and players, according to an embodiment.

FIG. 5B is a network diagram showing a network structure for a social networking web site and players, according to an embodiment. The online game which awards and stores loyalty points can also be accomplished by the system illustrated in FIG. 5B.

A computer communications network (such as the Internet) can be used to connect a host server 510 which can host and serve a social networking site. Note that while FIG. 5B shows only one server as the host server 510, the host server 510 can encompass numerous servers all cooperating with each other (whether in the same physical location or not). The host server 510 communicates with players 511, 512, 513 through the Internet (or other computer communication network) and can implement any of the methods herein by executing computer code programmed accordingly. Game server 514 can also implement all games and methods described herein on the site by executing computer code programmed accordingly. The game server 514 is connected to the Internet and can communicate with all of the players 511, 512, 513 directly or indirectly through the social networking site hosted by the host server 510. The game server 514 can cooperate with the host server 510 so that the games run on the game server 514 can be integrated into the social networking site hosted by the host server 510. The game server can also be optional and all of the games can be also hosted on the host server 510, whereby the integration of the games served/hosted by the game server 514 will appear embedded in the social networking site hosted by the host server 510 such that players would typically not realize (or care) that multiple servers are cooperating in order to play games on the social networking site. All of the communications described herein can be effectuated using such a network configuration. Typically, the communications are effectuated on the social networking site itself, thus the players 511, 512, 513 should be logged into the social networking site in order to participate herein, although logging in is not required (e.g., communications can be transmitted using other methods, such as email, IRC chat, instant message, etc.) The host server 510 can communicate with any of the devices illustrated in FIG. 1.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

In a further embodiment, loyalty points can be earned as described in U.S. application Ser. No. 14/144,581 which is incorporated by reference herein in its entirety. That is, loyalty points can be awarded a predetermined amount of loyalty point(s) after a predetermined amount of credits have been wagered (played). In an embodiment, some platforms will award loyalty points in this manner while some platforms will award loyalty points in a different manner. A platform is a mechanism which delivers the game to the player. For example, examples of utilizing the game on different platforms can be: i) going to a social networking site such as FACEBOOK using a web browser on a computer (e.g., personal computer) and then initiating the game as an application embedded inside the social networking site (e.g., a FACEBOOK app or FACEBOOK game); ii) accessing the game using an app downloaded on an ANDROID phone; iii) accessing the game using an app downloaded on an IPHONE. Different reward paradigms (ways players can earn loyalty points) can be in place for different platforms. For example, the way loyalty points are awarded on an IPHONE (using an app running on the IPHONE) can be different from the way loyalty points are awarded on an ANDROID (using an app running on the ANDROID phone).

Figure 6:
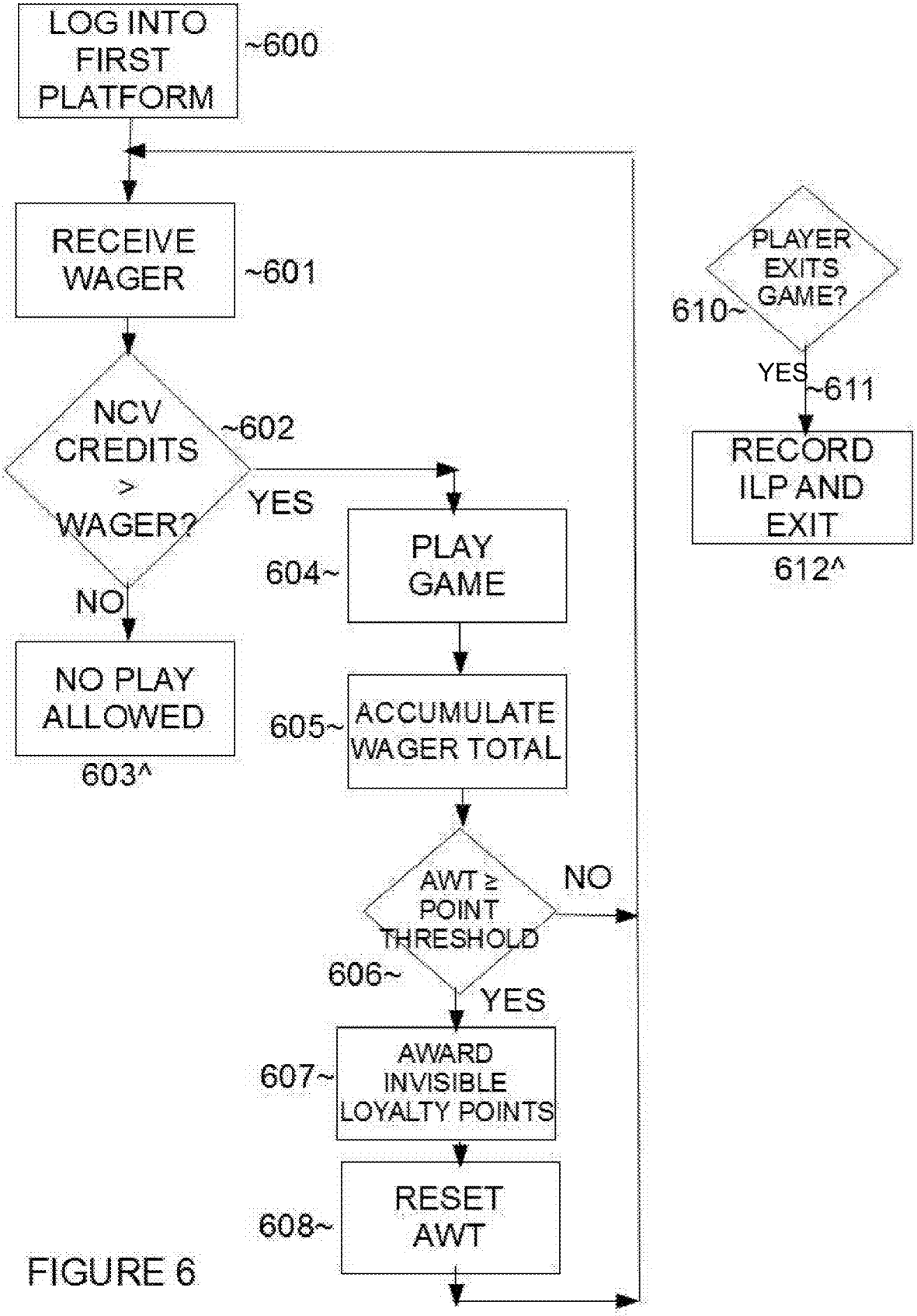
FIG. 6 illustrates one embodiment of awarding invisible loyalty points, according to an embodiment.

FIG. 6 illustrates one embodiment of awarding invisible loyalty points, according to an embodiment.

In operation 600, a player first logs into a platform (e.g., initiates an ANDROID app). The very first time the player runs the ANDROID app for the game the player may be required to set up an account (or identify to the app the player's current account using a unique identifier such as an email address, etc.) When the player logs in, the accumulated wager total is initialized to zero.

From operation 600, the method proceeds to operation 601, which receives a wager from the player. This can be done as described herein (e.g., the player indicating using a GUI how many credits to wager on an upcoming game such as a slot machine game).

From operation 601, the method proceeds to operation 602, which determines whether the player has more NCV (non-cash value credits, also referred to as "credits" herein) than the wager amount set forth in operation 601 (in other words, does the player possess enough credits in the player's account to make the wager and play the game?) If not, then the method proceeds to operation 603, wherein the player cannot make the wager (but the player can be offered to make a lower wager amount of less credits or purchase more credits).

If in operation 602, the player has enough credits to make the wager, then the method proceeds to operation 603, which plays the game (spins the reels to an outcome and awards all wins to the player). The wager amount is deducted from the player's current credit meter.

From operation 603, the method proceeds to operation 605 which accumulates the wager total (adds the amount wagered in operations 601/604) to the accumulated wager total. In operation 606, if the accumulated wager total is not greater than equal to a point threshold (the amount of credits that must be wagered to earn a predetermined amount of loyalty points), then the method returns to operation 601 (the player has increased the accumulated wager total but not enough to earn more secret loyalty points yet).

If in operation 606 the accumulated wager total is greater than equal to the point threshold, then the method proceeds to operation 607 which awards the player a respective (predetermined) amount of invisible loyalty points. Invisible loyalty points are not displayed to the player and the player may not even realize they are being awarded but they are accumulated in the player's account (so that if the player leaves the game all invisible loyalty points earned remain owned by the player). This embodiment is similar to the embodiment described in U.S. application Ser. No. 14/144,581 (which is incorporated by reference herein in its entirety) but instead of outrightly awarding and displaying the player's amount of loyalty points the player receives no indication of loyalty points earned and instead they are awarded to the player in the form of secret loyalty points.

From operation 607, the method proceeds to operation 608, which resets the amount of the accumulated wager total to zero and returns to operation 601.

Operations 610-611 are constantly active, and if the player exits the game (e.g., by terminating an app running the game, closing a window running the game, etc.) in operation 610, then the method proceeds to operation 612 which records all of the player's earned invisible loyalty points in the player's account. Operation 612 may not be necessary if the invisible loyalty points are already recorded in the player's account during another operation.

Thus, by the method in FIG. 6, the player earns invisible loyalty points which the player does not know about but typically would amount to the same amount of loyalty points (standard loyalty points as described herein) if paradigm being implemented awarded the standard loyalty points (instead of the invisible loyalty points). Some platform(s) would be programmed to implement the standard loyalty point paradigm while other platform(s) would be programmed to implement the invisible loyalty point paradigm.

Figure 7:
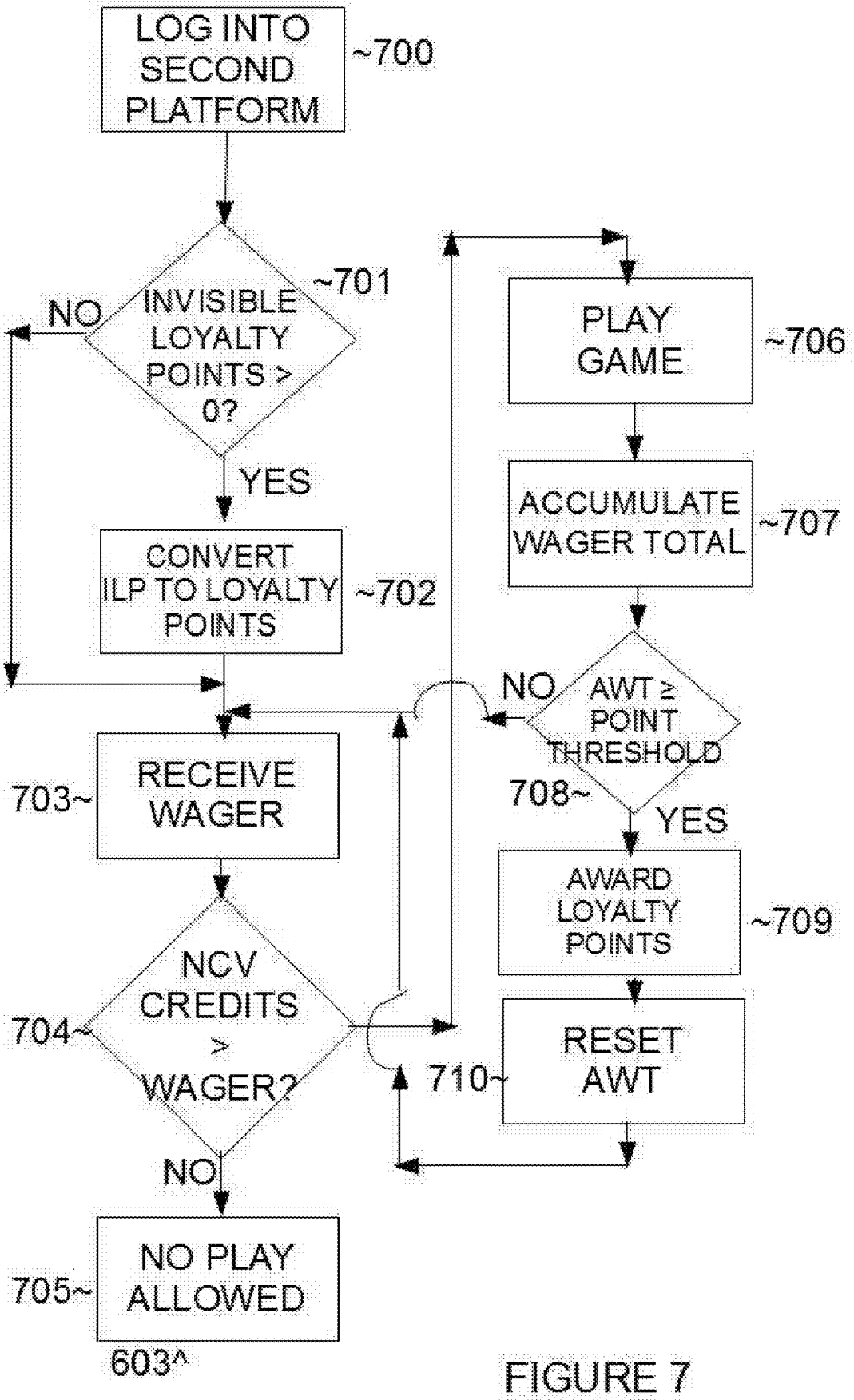
FIG. 7 is a flowchart illustrating an exemplary method of redeeming invisible loyalty points, according to an embodiment.

FIG. 7 is a flowchart illustrating an exemplary method of redeeming invisible loyalty points, according to an embodiment.

In operation 700, the player logs into a second platform (different from the first platform which awarded the player the invisible (or secret) loyalty points).

From operation 700, the method proceeds to operation 701, which determines whether the particular player has any (unconverted) invisible loyalty points in his/her account. If not, then the method proceeds to operation 703, which receives a wager from a player.

If in operation 701, it is determined that the player has unconverted invisible loyalty points in his/her account, then the method proceeds to operation 702 which converts the invisible loyalty points to loyalty points (regular loyalty points). The conversion can be done on an even basis (e.g., 1 invisible loyalty point equals 1 loyalty point) or using a conversion ratio (e.g., multiplying the invisible loyalty points by a constant). The loyalty points resulting from the conversion are then added to the player's total available loyalty points (a message to the player may or may not be displayed, depending on the embodiment, that this conversion has taken place along with the number of additional loyalty points the player now has). For example, if the player played the game on a platform which implements FIG. 7 and earned 10 loyalty points, and then the player played the game on a platform which implements FIG. 6 and earned 5 invisible loyalty points, then the player returns to the platform which implements FIG. 7 and the 5 invisible loyalty points are not converted to loyalty points so the player now has 15 loyalty points (and 0 invisible loyalty points). It is noted that the games offered would be the same across different platforms (e.g., APPLE, ANDROID, etc.) even though the manner of earning loyalty points may be different.

Operations 703, 704, 705, 706, 707, 708, 709, and 710 are implemented as described herein with respect to their counterpart operations (e.g., in FIG. 6, respectively, 601, 602, 603, 604, 605, 606, 607, 608) with the only different that operation 709 awards loyalty points (regular loyalty points not invisible loyalty points) instead of awarded invisible loyalty points (in operation 607).

Figure 8:
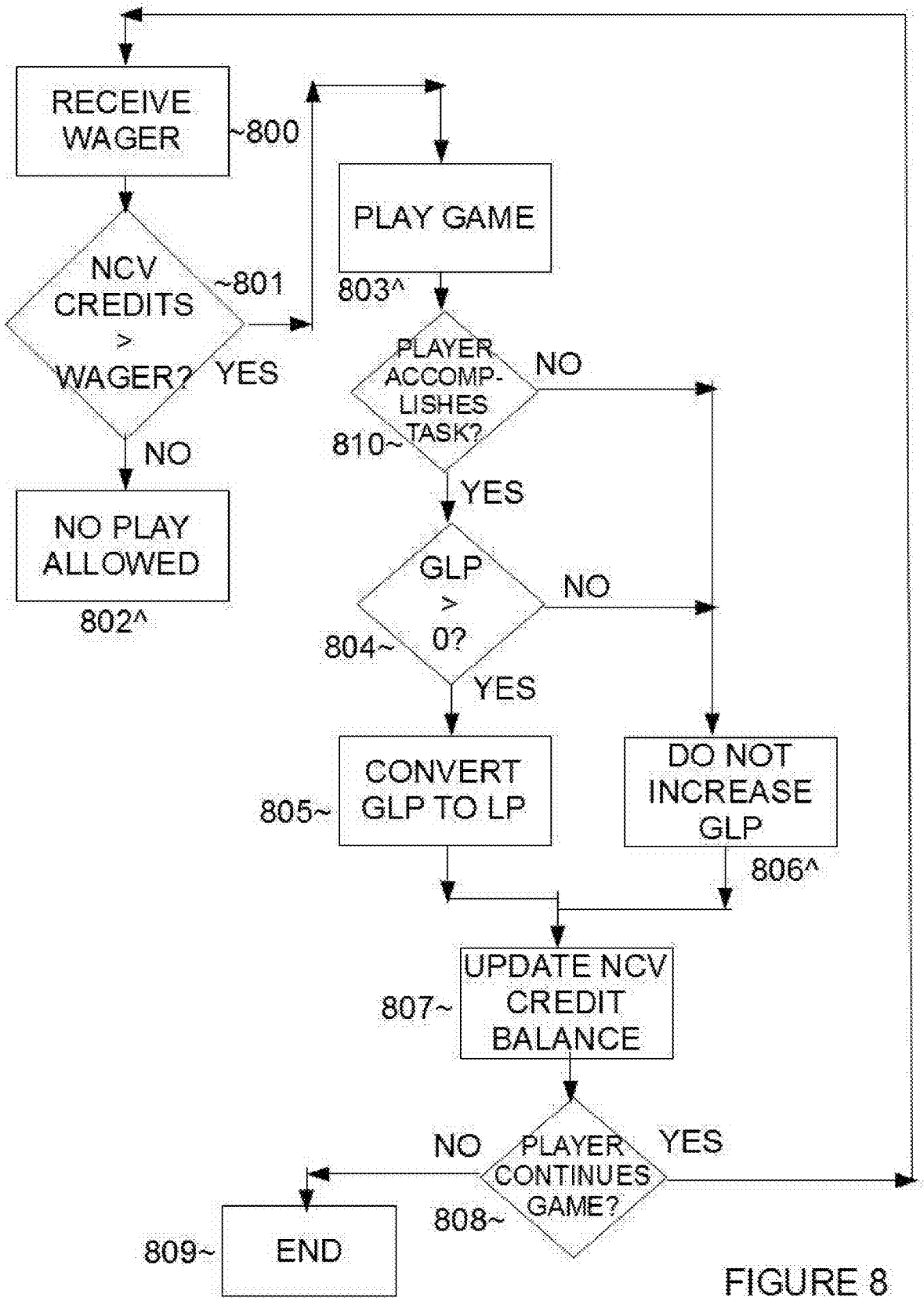
FIG. 8 is a flowchart illustrating an exemplary method of implementing a skill wagering game with guaranteed loyalty points, according to an embodiment.

FIG. 8 is a flowchart illustrating an exemplary method of implementing a skill wagering game with guaranteed loyalty points, according to an embodiment.

In a further embodiment, instead of a game based on pure luck such as spinning of a slot machine, a skill game can be implemented which can convert guaranteed loyalty points (GLP) to loyalty points (LP) based on the player accomplish a task based on skill. For example, an arcade game can be presented wherein the player has to shoot aliens, and each time an alien is successfully shot by the player then a conversion can be initiated from GLP to LP. In this manner, the player is appearing to earn LP based on his/her skill in the game, although in reality the player's skill does not affect the total amount of LP the player will eventually earn because ultimately he player can or will receive a conversion of all of their GLP to LP as described herein. This embodiment operates the same as the other embodiments described above (e.g., FIGS. 3-4) but instead of converting GLP to LP merely by playing the game (e.g., spinning a reel, etc.) the GLP is converted to LP when the player accomplishes a task. The task can be any skill, pseudo skill, or even random task, such as shooting an targeting, landing a projectile in a target (e.g., ball in a basket), driving a car with crashing, completing a puzzle game (such as Sudoku, etc.) and any other task that can be implemented in a video type game. When such a task is completed, then a predetermined (or variable) amount of GLP is converted to LP (e.g. every target hit will result in the player earning 5 LPs which is converted from 5 GLP).

FIG. 8 operates the same as FIG. 3 (i.e. operation 800 operates the same as operation 300, operation 801 operates the same as operation 301, etc., thus see the description with regard to FIG. 3) except for new operation 810 (between operations 803 and 804) which determines whether the player accomplished a task (successfully shooting a target with a launcher, etc.) Note that the game in operation 803 is a game which the user has some control over what is happening (e.g., firing at a target, etc.) If the task was not accomplished successfully (e.g., the player missed a target), then the method proceeds to operation 806 which would not increase the GLP. If the task was accomplished successfully, then the method proceeds to operation 804. In an embodiment, a task can be "partially successful" (e.g., the player does not destroy a target but does hit and weaken it) upon which "partial credit" is given (meaning it is considered that the task was accomplished but less GLP points would be converted to LP than if the task was fully accomplished).

When the player hasn't achieved enough tasks to convert all of his GLP to LP points, then all of the player's GLP points can still be converted to LP points in 30 days (or any other time interval) or any other method described herein with regard to the conversion of GLP to LP. Regardless of the player's skill in the skill game and regardless of how successful the player is with the tasks, the player will still ultimately receive all of his/her GLP in the form of LP, thereby removing the player's skill factor from the player's ultimate earning potential.

Figure 9:
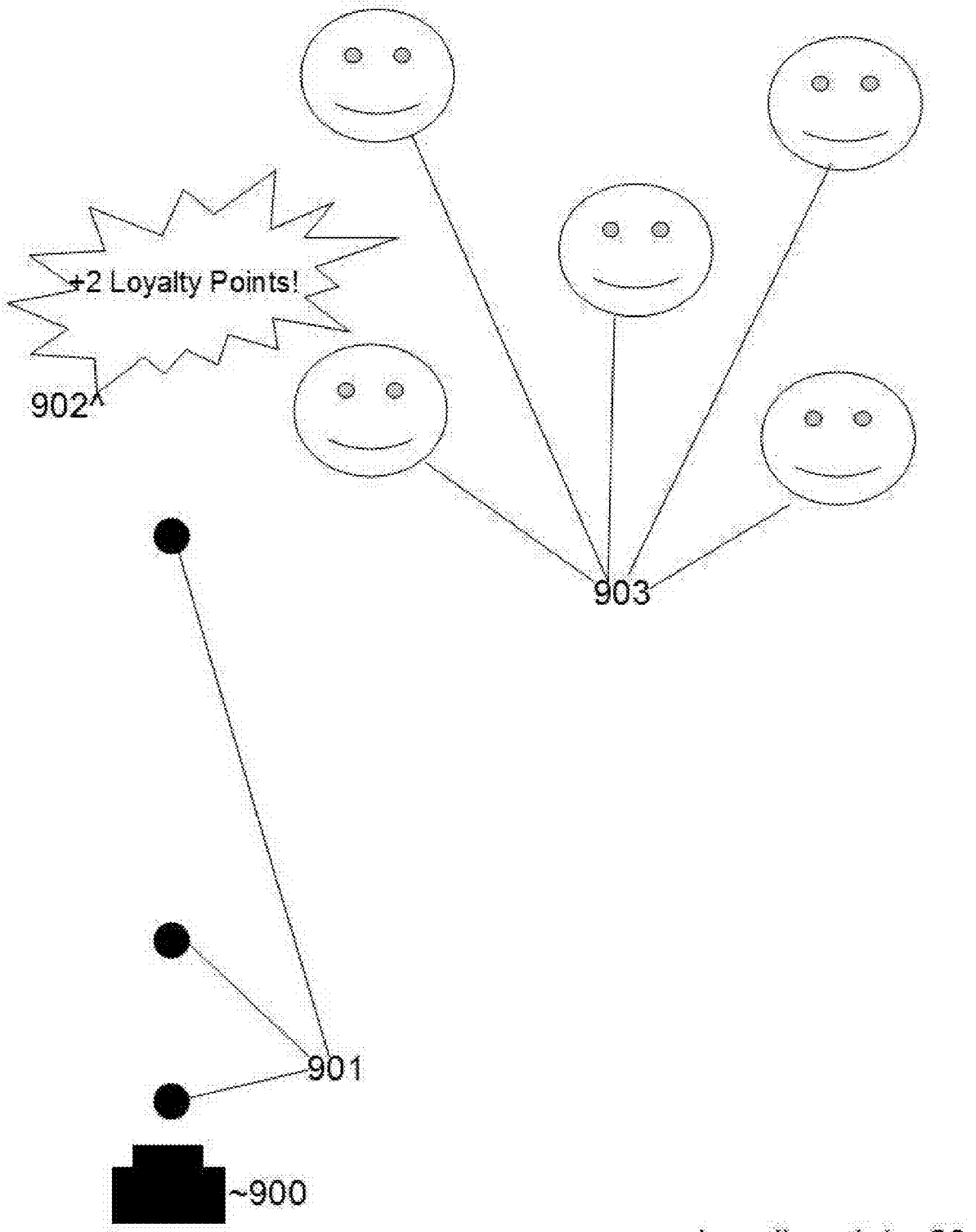
FIG. 9 is a drawing of a skill game, according to an embodiment.

FIG. 9 is a drawing of a skill game, according to an embodiment. The embodiments described herein with regard to a skill game/task can be applied to this type of game (or any other type of game).

A launcher 900 is used to launch projectiles 901 upon pressing an input device (e.g., controller, keyboard buttons, mouse, touch-screen, etc.) The launcher can typically be moved around the display (e.g., left and right) as well by the player's input device. The task is for the player to hit targets 903 with projectiles 901 fired from the launcher 900. If one is hit 902, then the player is awarded loyalty points (in operations 805, 807). Any such game which features objects controlled by a player can be implemented using the methods described herein.

Three different paradigms for providing loyalty points have been described herein (guaranteed loyalty points, invisible loyalty points, and the regular loyalty points). In one embodiment, accessing the game server(s) (and hence the games) are would all use the same loyalty point paradigm regardless of the platform used to access the games. In another embodiment, different platforms would utilize different paradigm(s) of providing loyalty points. For example, accessing the game inside a social networking web site (e.g., FACEBOOK) using a standard web browser on a standard personal computer would utilize the standard (regular loyalty points (also referred to as loyalty points)) paradigm, while accessing the games using a different platform (such as an app on an ANDROID phone and/or an app on an IPHONE (IOS operating system) would utilize a different paradigm (such as guaranteed loyalty points and/or invisible loyalty points).

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All features described herein (including all documents incorporated by reference) can be combined with one another without limitation. While the "credits" are used herein to refer to awards provided to players typically refers to non-cash value credits, this can also refer to cash credits as well (that are directly redeemable for cash).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a game, the method comprising:

executing instructions which perform the following operations on an electronic processing unit:

providing a player a total amount of guaranteed loyalty points and a total amount of loyalty points;

a) receiving a wager of non-cash value credits from the player to play a slot machine game, wherein the non-cash value credits are purchased by the player with cash, wherein the non-cash value credits are not redeemable for cash;

b) implementing the slot machine game which pays awards in non-cash value credits;

c) when the total amount of guaranteed loyalty points is greater than zero, converting some of the total amount of guaranteed loyalty points to an amount of loyalty points which is added to the total amount of loyalty points, wherein the converting subtracts the some of the total amount of guaranteed loyalty points from the total amount of guaranteed loyalty points, wherein when the total amount of guaranteed loyalty points is not greater than zero then the total amount of loyalty points is not increased and the total amount of guaranteed loyalty points is not increased;

repeating a), b), and c) until the player stops playing; and enabling the player to redeem the total amount of loyalty points for tangible goods.

2. The method as recited in claim 1, wherein the total amount of loyalty points is displayed to the player.

3. The method as recited in claim 2, wherein the total amount of guaranteed loyalty points is not displayed to the player.

4. The method as recited in claim 1, further comprising after the player purchases non-cash value credits for cash, increasing the total amount of guaranteed loyalty points.

5. The method as recited in claim 1, wherein an amount of the some of the total amount of guaranteed loyalty points converted is based on an amount of the wager.

6. The method as recited in claim 1, further comprising making a predetermined award amount of loyalty points to the player which is added to the total amount of loyalty points, the predetermined award amount of loyalty points being the same for all players.

7. The method as recited in claim 6, wherein the predetermined award amount of loyalty points is presented to the player in a game form which results in the predetermined award amount of loyalty points being added to the total amount of loyalty points.

8. The method as recited in claim 1, further comprising making a random award of loyalty points to the player which is converted from the total amount of guaranteed loyalty points to a corresponding amount of loyalty points which is added to the total amount of loyalty points.

9. An apparatus to implement a game, the apparatus comprising:

an electronic server connecting to the Internet, the electronic server configured to read and execute computer readable instructions which are programmed to cause the server to:

provide a player a total amount of guaranteed loyalty points and a total amount of loyalty points;

a) receive a wager of non-cash value credits from the player to play a slot machine game, wherein the non-cash value credits are purchased by the player with cash, wherein the non-cash value credits are not redeemable for cash;

b) implement the slot machine game which pays awards in non-cash value credits;

c) when the total amount of guaranteed loyalty points is greater than zero, convert some of the total amount of guaranteed loyalty points to an amount of loyalty points which is added to the total amount of loyalty points, wherein the convert operation subtracts the some of the total amount of guaranteed loyalty points from the total amount of guaranteed loyalty points, wherein when the total amount of guaranteed loyalty points is not greater than zero then the total amount of loyalty points is not increased and the total amount of guaranteed loyalty points is not increased;

repeat the a), b) and c) until the player stops playing; and enable the player to redeem the total amount of loyalty points for tangible goods.

10. The apparatus as recited in claim 9, wherein the server is further programmed such that the total amount of loyalty points is displayed to the player.

11. The apparatus as recited in claim 10, wherein the server is further programmed such that the total amount of guaranteed loyalty points is not displayed to the player.

12. The apparatus as recited in claim 9, wherein the server is further programmed such that after the player purchases non-cash value credits using cash, the total amount of guaranteed loyalty points in increased.

13. The apparatus as recited in claim 9, wherein the server is further programmed such that an amount of the some of the total amount of guaranteed loyalty points converted is based on an amount of the wager.

14. The apparatus as recited in claim 9, wherein the server is further programmed to make a predetermined award amount of loyalty points to the player which is added to the total amount of loyalty points, the predetermined award amount of loyalty points is the same for all players.

15. The apparatus as recited in claim 14, wherein server is further programmed such that the predetermined award amount of loyalty points is presented to the player in a game form which results in the predetermined award amount of loyalty points being added to the total amount of loyalty points.

16. The apparatus as recited in claim 9, wherein the server is further programmed to make a random award of loyalty points to the player which is converted from the total amount of guaranteed loyalty points to a corresponding amount of loyalty points which is added to the total amount of loyalty points.

* * * * *